US007331098B2

(12) United States Patent
Matthews et al.

(10) Patent No.: US 7,331,098 B2
(45) Date of Patent: Feb. 19, 2008

(54) FASTENER INSERTION APPARATUS

(75) Inventors: Shane Peter Matthews, Chester (GB); Stuart Blacket, Queensland (AU); Wojciech Gostylla, Queensland (AU)

(73) Assignee: Henrob Limited (GB)

( * ) Notice: Subject to any disclaimer, the term of this patent is extended or adjusted under 35 U.S.C. 154(b) by 100 days.

(21) Appl. No.: 11/252,323

(22) Filed: Oct. 17, 2005

(65) Prior Publication Data

US 2006/0090320 A1 May 4, 2006

Related U.S. Application Data

(62) Division of application No. 10/427,071, filed on Apr. 30, 2003, now Pat. No. 6,986,450.

(51) Int. Cl.
*B21D 39/00* (2006.01)

(52) U.S. Cl. ..... 29/524.1

(58) Field of Classification Search ..... 29/524.1, 29/34 B; 227/138, 119, 139, 114, 112, 107, 227/108

See application file for complete search history.

(56) References Cited

U.S. PATENT DOCUMENTS

| | | | |
|---|---|---|---|
| 2,493,868 | A | 1/1950 | Griffen |
| 3,029,918 | A | 4/1962 | Stover |
| 3,789,490 | A | 2/1974 | Kohart |
| 4,044,462 | A | 8/1977 | Anselmo |
| 4,174,802 | A | 11/1979 | Maestri |
| 4,404,742 | A | 9/1983 | Fuhrmeister |
| 4,615,475 | A | 10/1986 | Fuhrmeister |
| 4,765,057 | A | 8/1988 | Muller |
| 5,011,339 | A | 4/1991 | Aurtoi et al. |
| 5,201,892 | A | 4/1993 | Salter |
| 5,299,351 | A | 4/1994 | Takahashi et al. |
| 5,351,392 | A | 10/1994 | Wing |
| 5,452,630 | A | 9/1995 | Haas et al. |

(Continued)

FOREIGN PATENT DOCUMENTS

| | | |
|---|---|---|
| DE | 29719744 | 2/1998 |
| EP | 0922538 | 6/1999 |
| GB | 2300183 | 10/1996 |
| JP | 56077042 | 6/1981 |
| WO | WO 9528242 | 10/1995 |
| WO | WO 0007751 | 2/2000 |

*Primary Examiner*—John C. Hong
(74) *Attorney, Agent, or Firm*—Michael Best & Friedrich, LLP

(57) ABSTRACT

Fastener insertion apparatus comprises a nose having a fastener delivery passage and side entry port. Fasteners such as rivets are supplied to the nose via a fastener supply passage and a fastener feeder assembly. A punch reciprocally disposed for movement in the delivery passage drives a fastener disposed in the delivery passage out of the passage and into a workpiece. The feeder assembly comprises a gate that is movable between retracted and advanced positions. In the retracted position it is clear of the supply passage and the delivery passage so as to permit movement of a fastener from the supply passage to the delivery passage. In the advanced position it at least partially closes the supply passage so as to prevent movement of a fastener and it projects into the delivery passage through the entry port so as to retain a fastener, if present, in the delivery passage. Sensors are provided to detect the position of the gate. The invention permits different size rivets to be supplied to the same tool and reduces the rivet cycle time. The apparatus can also be used in a clinching operation with or without a fastener.

7 Claims, 8 Drawing Sheets

U.S. PATENT DOCUMENTS

| | | | | |
|---|---|---|---|---|
| 5,472,087 | A | 12/1995 | Rink et al. | |
| 5,476,204 | A | 12/1995 | Eisenpresser et al. | |
| 5,579,975 | A | 12/1996 | Moorman | |
| RE35,619 | E | 10/1997 | Muller | |
| 5,752,305 | A | 5/1998 | Cotterill et al. | |
| 5,772,098 | A | 6/1998 | Crutcher | |
| 5,779,127 | A | 7/1998 | Blacket et al. | |
| 5,813,114 | A | 9/1998 | Blacket et al. | |
| 5,815,914 | A | 10/1998 | Kamps et al. | |
| 5,974,660 | A | 11/1999 | Muller | |
| 5,988,026 | A | 11/1999 | Reckelhoff et al. | |
| 6,006,975 | A | 12/1999 | Ishizawa | |
| 6,027,004 | A | 2/2000 | Ramella et al. | |
| 6,431,427 | B1 | 8/2002 | Leitner | |
| 6,592,015 | B1 | 7/2003 | Gostylla et al. | |
| 6,598,777 | B2 | 7/2003 | Osuga et al. | |
| 6,679,412 | B1 | 1/2004 | Thomas et al. | |
| 6,708,860 | B1 | 3/2004 | Thieleke | |
| 6,786,379 | B2 | 9/2004 | Largo | |
| 6,789,718 | B2 | 9/2004 | Canlas et al. | |
| 6,986,450 | B2 * | 1/2006 | Matthews et al. | 227/138 |
| 7,131,564 | B2 * | 11/2006 | Matthews et al. | 227/138 |

* cited by examiner

FIG. 2
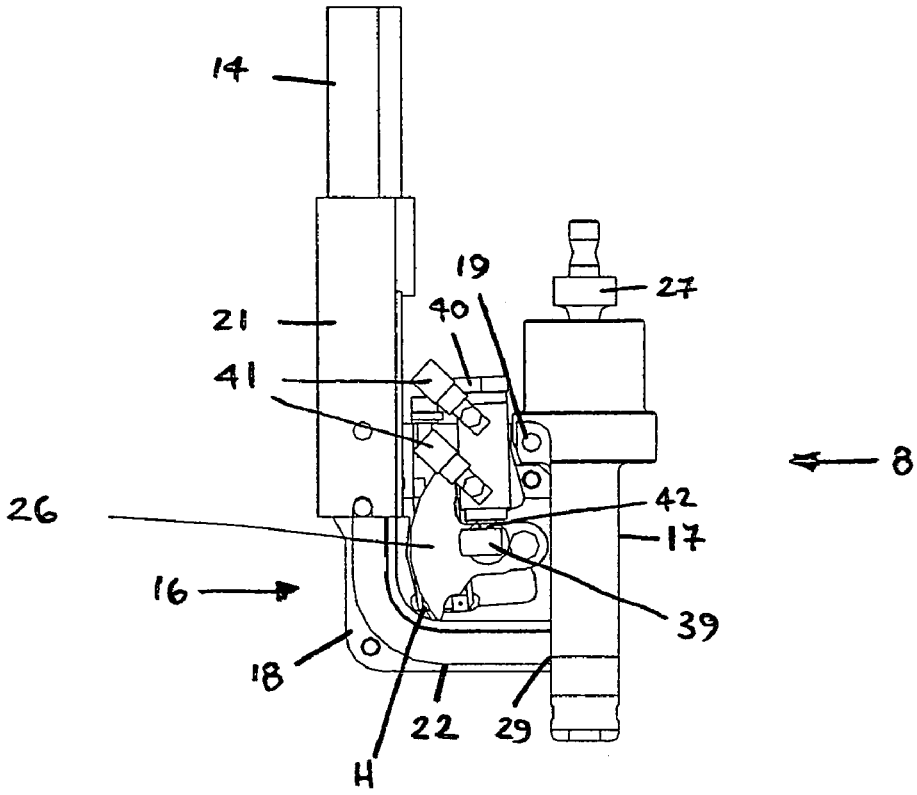
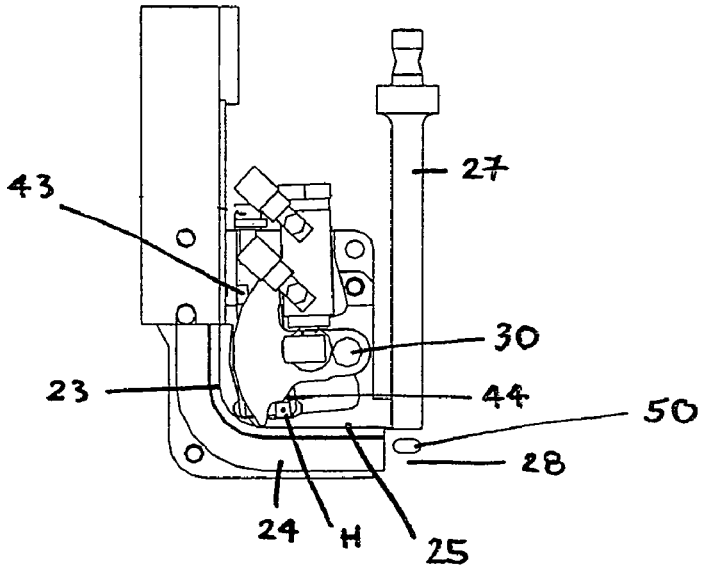
FIG. 3

FIG. 4
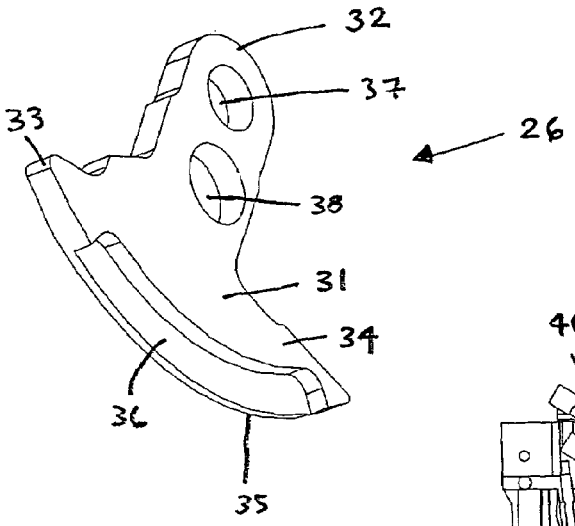
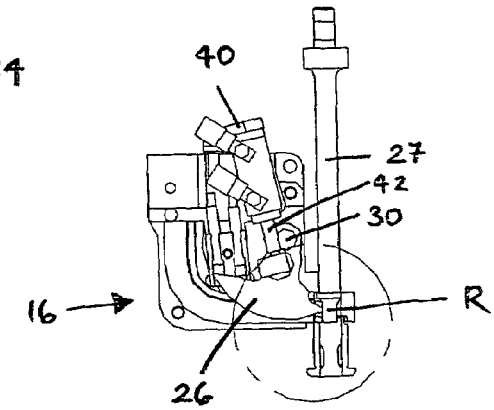
FIG. 5
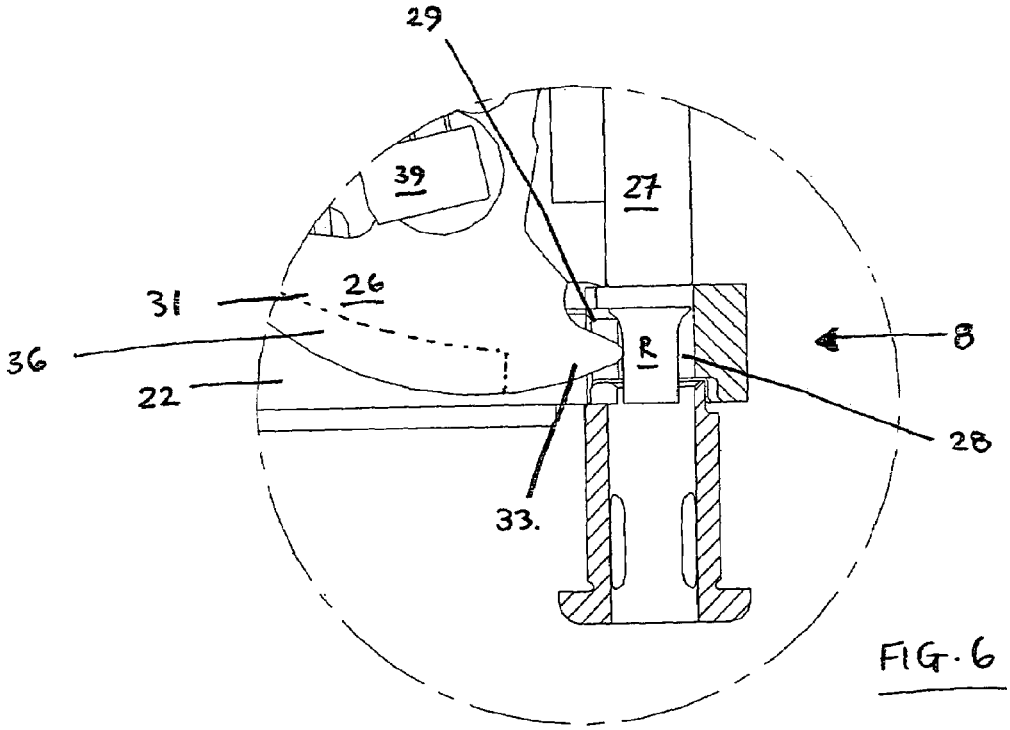
FIG. 6

FIG. 7
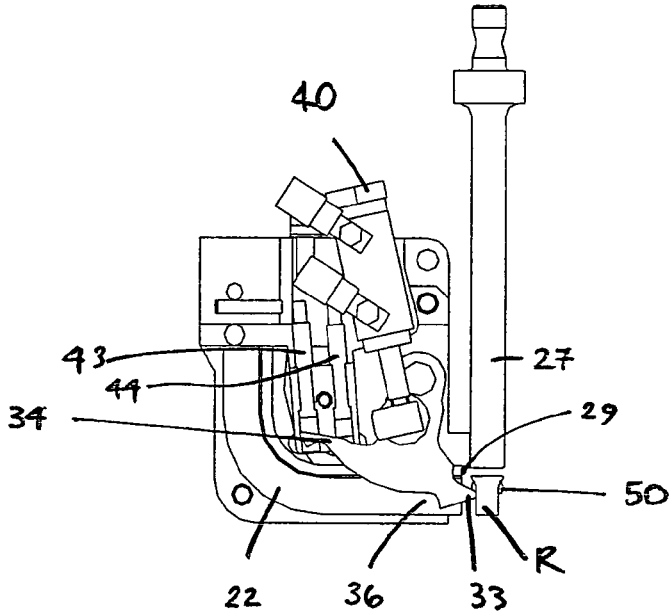
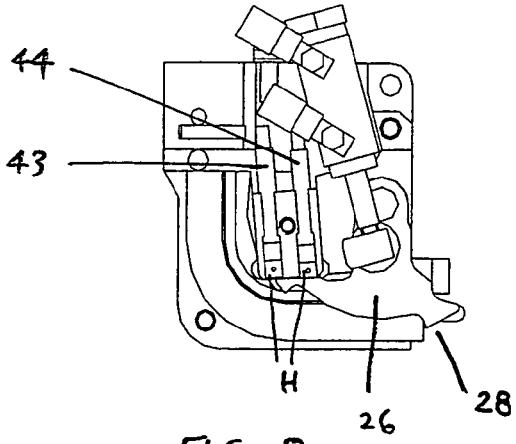
FIG. 8

FIG. 10
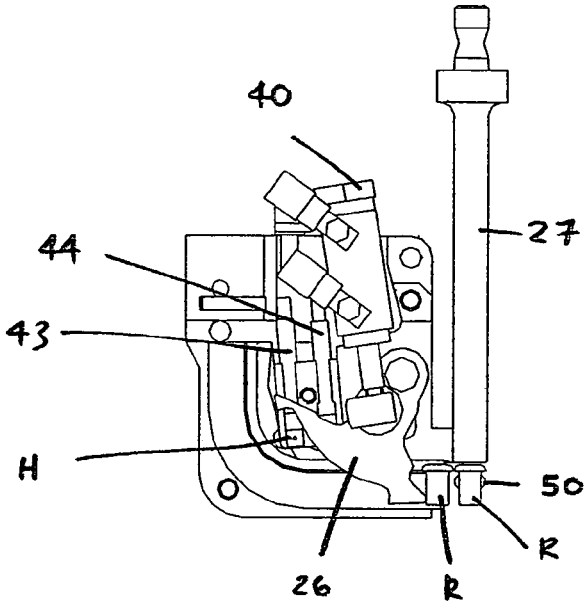
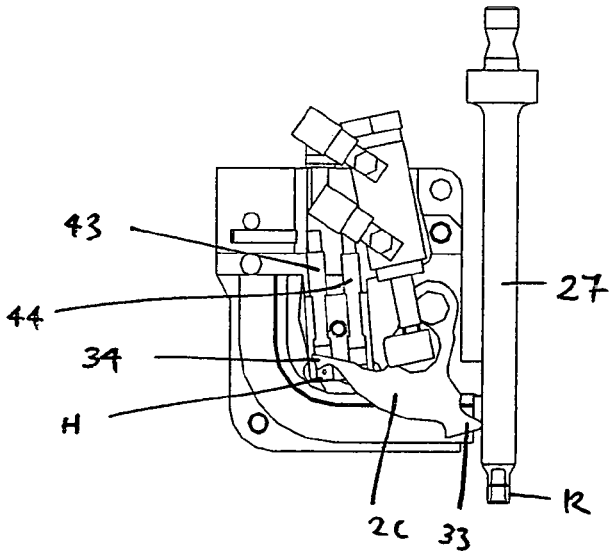
FIG. 9

FIG 11
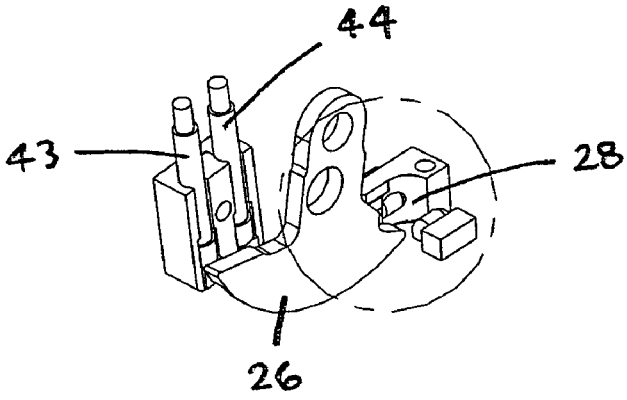
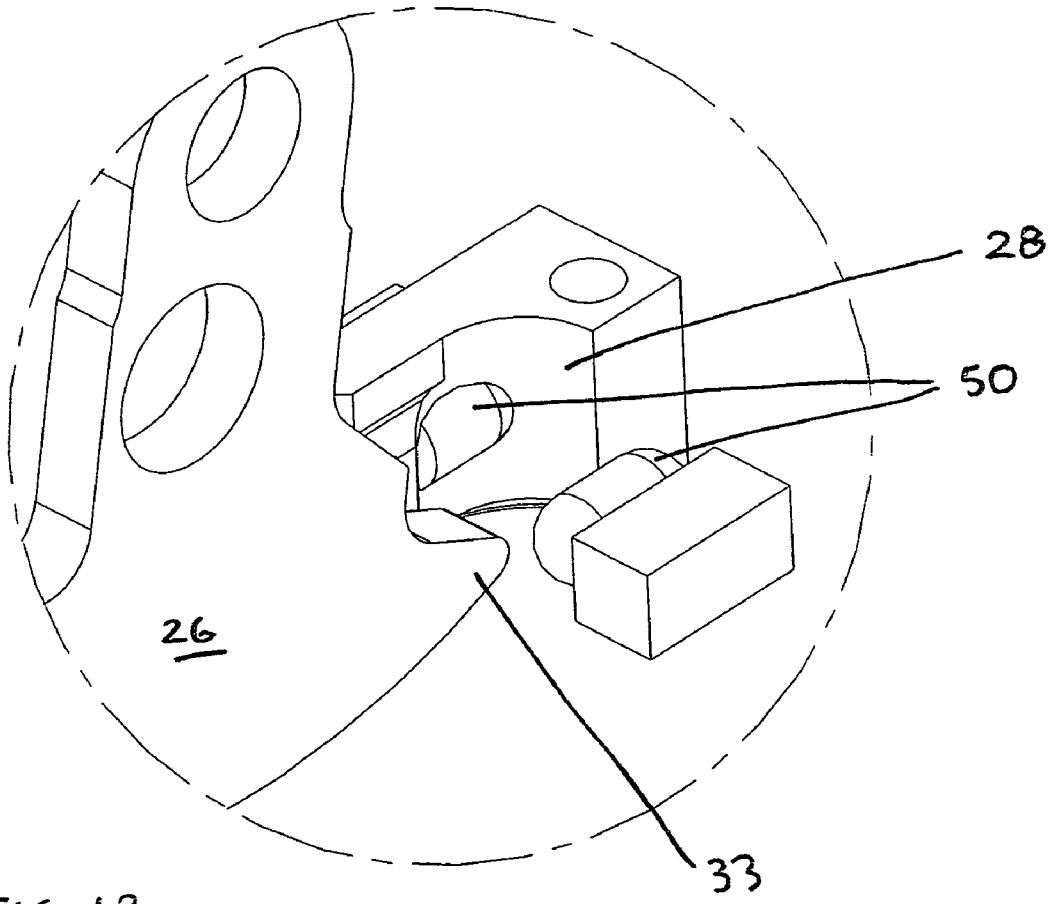
FIG 12

FIG. 13
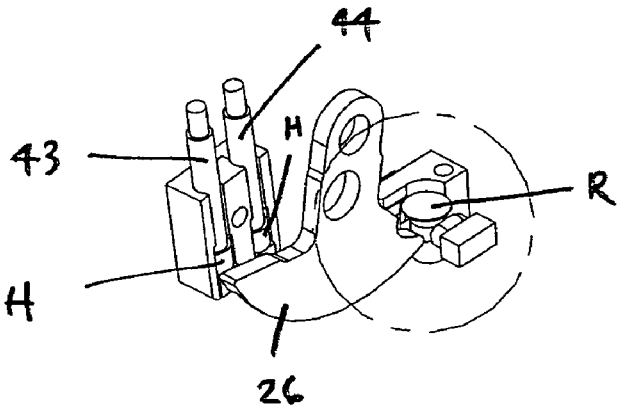
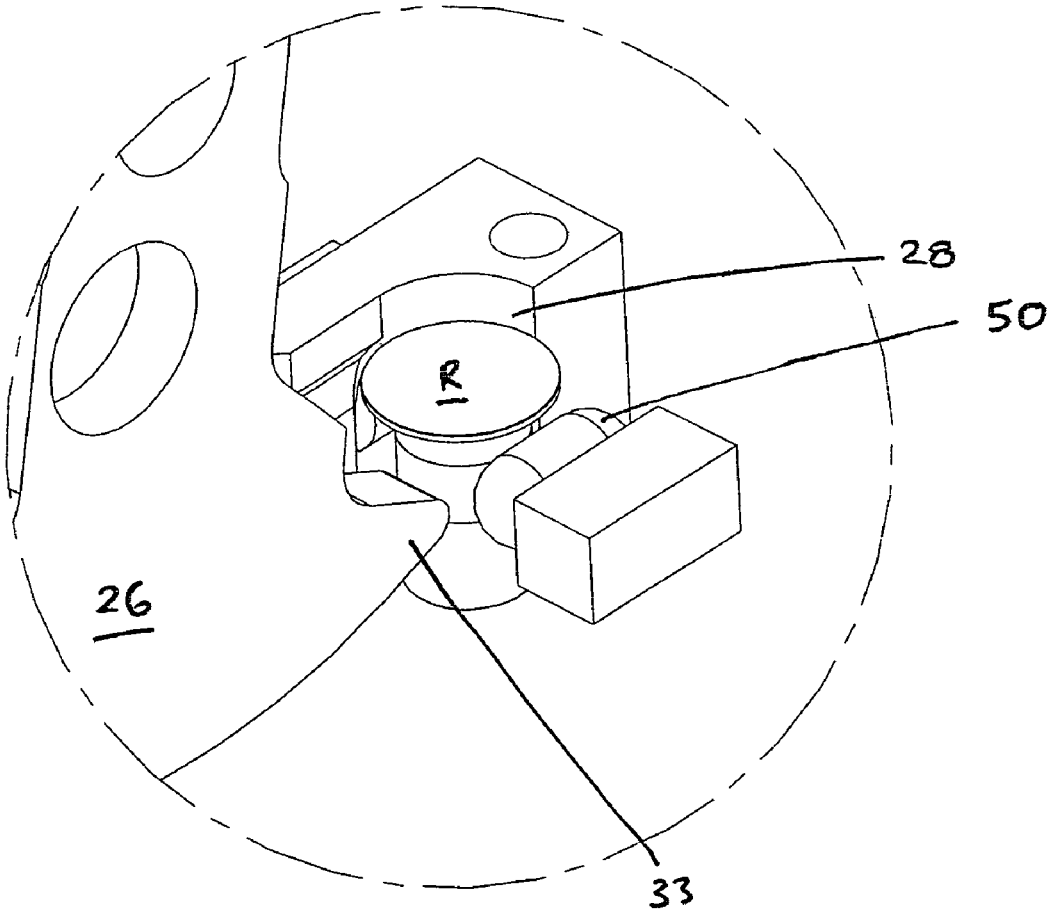
FIG. 14

FIG. 15
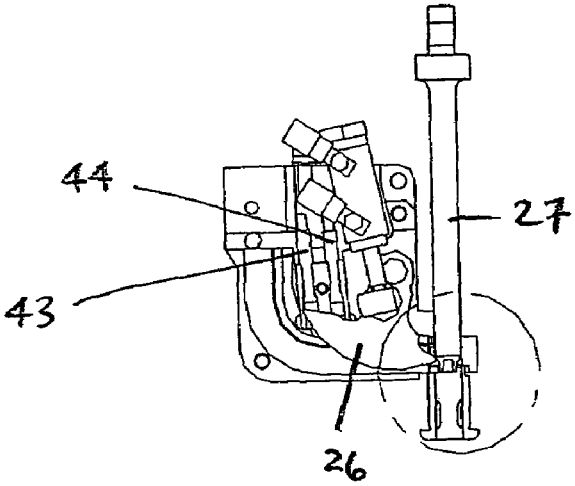
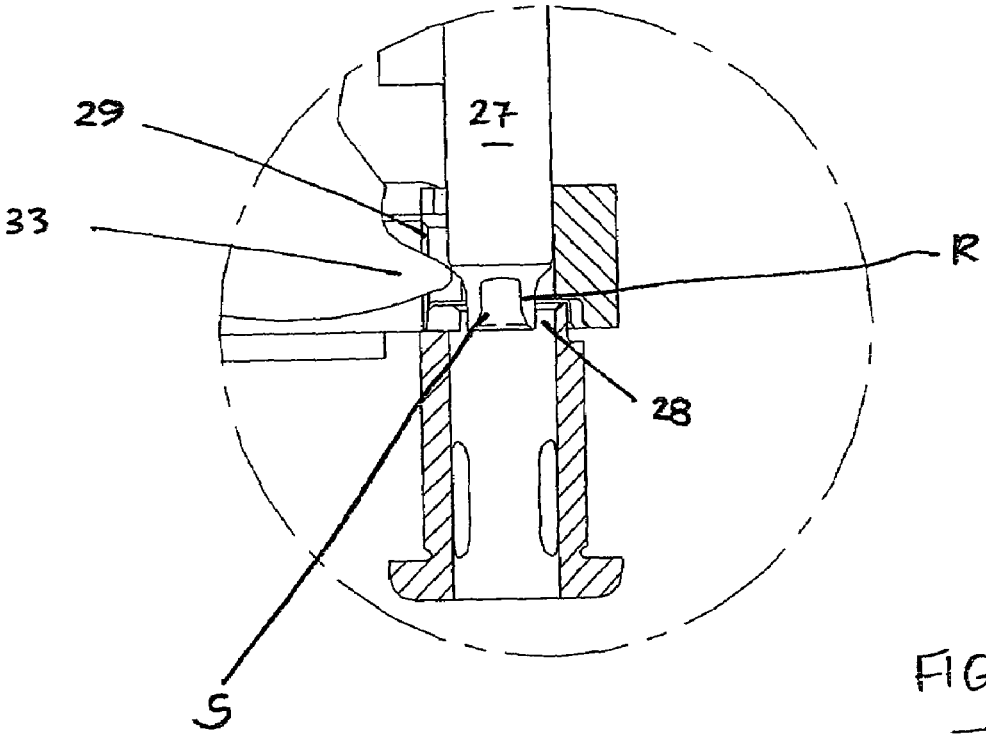
FIG. 16

FASTENER INSERTION APPARATUS

CROSS-REFERENCE TO RELATED APPLICATION

This application is a divisional application of U.S. patent application Ser. No. 10/427,071, entitled "Fastener Insertion Apparatus" filed Apr. 30, 2003, now U.S. Pat. No. 6,986,450 by Shane Peter Matthews, Stuart Blacket, and Wojciech Gostylla.

BACKGROUND OF THE INVENTION

The present invention relates to fastener insertion apparatus and a feeder assembly therefor.

The term "fastener" is used herein to include rivets, screws, slugs and other types of fastening devices.

In one known type of fastening technology rivets are delivered to a rivet setting tool via a delivery tube in which the rivet is propelled by, for example, compressed air. At the end of the delivery tube the rivet is typically transferred to a rivet delivery passage in a nose of a setting tool. An alignment or retaining device disposed in the nose holds the rivet in coaxial alignment with the passage ready for insertion into a workpiece. When the rivet is in this position a punch descends along the rivet delivery passage and drives the rivet into the workpiece so that it is deformed by an upsetting die disposed below the workpiece. In an alternative design the fasteners are retained in a carrier tape and are advanced with the tape so that they are brought sequentially into alignment with the punch and die assembly by a feeder before the punch is actuated to drive the fastener out of the tape and into the workpiece as before.

In another current fastening method known as clinching workpieces are mechanically interlocked by deforming them into each other with or without using a fastener such as a rivet. A punch descends along a passage and impacts directly on to a workpiece so that the latter is deformed in a die disposed below the workpiece. This technology is usually used to join two or more sheets of material but can be used to form a deformation in a single sheet for locating a component to be connected to or positioned adjacent to the sheet.

Modern mechanical joining tools such as, for example, rivet setters are generally microprocessor controlled and often combined with robot technology. The tools are operated under the control of a computer program that provides instructions relating to the joining position and type (including fastener type (if any) and process parameters) for each joint to be effected in a particular workpiece. The type of fastening to be used is selected according to many factors including the size of the parts to be connected. A fastener delivery system associated with the tool must thus be able to cope with the supply of rivets of different sizes and types in any particular sequence without increase to the fastening cycle time and the tool must be able to produce a clinched joint with or without a fastener.

Fasteners having different aspect ratios (fastener length to head diameter) are fed in different orientations. For example, fasteners with a low aspect ratio are susceptible to tumbling in the delivery tube, which must therefore be of T-shape, or rectangular cross-section and fasteners with a high aspect ratio are typically transported axially in tubes of circular cross-section In certain fastening applications several rivet sizes are required for a workpiece or section of a workpiece if, for example, it comprises overlapping sheets or there is a requirement to attach a bracket to another component, in which case the sandwich thickness of the workpiece varies from two sheets to three sheets or more. In other applications it may be necessary to have a mix of riveted and clinched joints. When self-piercing riveting technology is employed, one of the factors determining the strength of a riveted joint is the length of the rivet in relationship to the sandwich thickness of the material to be fastened. When clinching technology is employed, the geometry and size of both the punch and the die and the presence or absence of an additional fastener are important factors in the performance of the joint. The mechanical properties of joints riveted with the same size of rivet will vary depending on the sandwich thickness and the material being fastened. In a continuous production environment, conventional self-piercing riveting tools are generally dedicated to a single rivet size and the problem of riveting combinations of different thicknesses and types of material that cannot be accommodated by a single rivet size is addressed by using several dedicated tools each applying a different rivet size. Obviously this requires careful planning as increased combinations of different joint thicknesses, types and strengths require additional rivet sizes and/or different clinching processes and therefore increased numbers of tools. Certain known fastening tools have twin feeds and are able to supply more than one type of fastener but they generally cannot supply a large range of fasteners and the feeding of fasteners to the nose of the tool can be unreliable. It would clearly be desirable to provide reliable fastener insertion apparatus capable of delivering a large range of fastener sizes as this would enable production environments to rationalize tool costs including economizing on spare parts and back -up systems.

In applications of this kind rivet delivery can be a problem in that there is no provision for dealing with a plurality of rivets that may have been accidentally fed into the nose. Moreover, effective delivery relies purely on the momentum of the rivet as it travels down the delivery tube. It will be understood that the rivet momentum is variable with the air pressure supply (that propels the rivets along the tube), rivet mass and restrictions in the passage of the delivery tube (caused by kinks, bends, dirt and wear etc).

Finally, there is generally a slow cycle time associated with such transfer arrangements. Rivets are fed separately to the nose and the cycle time is thus dependent on the length of the delivery tube.

In a known configuration a transfer station is disposed between the nose and the delivery tube. Rivets are stopped at the transfer station and are transferred to the nose by a pusher. While this arrangement reduces the cycle time in that rivets can be collected at the transfer station, the other disadvantages referred to above are not solved.

Our European Patent No. 0746431 describes a fastening machine in which rivets are supplied under pressure via a delivery tube to the rivet delivery passage in the nose of a setting tool. The delivery tube may be T-shaped rectangular or of other profiled section. The rivet enters the delivery passage in a substantially perpendicular direction and is supported therein by balls, rollers or other protrusions prior to engagement of the punch with the rivet. A limit switch is used to sense the presence of a rivet in the delivery tube and issues a signal to a controller to indicate that the punch may be actuated. The travel of the rivet through the delivery passage under the punch is controlled by a vertical array guide elements such as rows of balls or fingers or other protrusions on the wall of the delivery passage.

Our European Patent application No. 99936862.4 describes many aspects of a fastener delivery system. One aspect is concerned with the transfer of fasteners from the delivery tube or magazine into the fastener delivery passage of a nose of the setting tool. In all embodiments there is a transfer station that manages the transfer of the fasteners individually into the nose while ensuring that they are correctly aligned with the punch. In all embodiments the fastener is delivered under pressure in a tube to a gate at the transfer station where its presence is sensed and a pusher is used to force the fastener through the gate into the nose. The pusher is then retracted prior to advance of the punch so as to prevent damage to the transfer station. Once the rivet has been passed from the transfer station into the nose there is no means for checking it has been safely loaded.

European patent application No. 0922538 (Emhart) describes a feeder arrangement for transferring fasteners into a fastener delivery passage of a setting tool. The arrangement comprises a fastener feed duct having a T-shaped cross-section in which fasteners are delivered to a transfer station immediately adjacent to the nose of the setting tool. The transfer station comprises a conveying duct with a catch unit in the roof thereof. When the fastener is supplied its head comes into frictional contact with the catch and is decelerated slightly before it passes into the nose so as to ensure reliable passage of the fastener into the nose. The catch can prevent a head of a rivet from falling back through an entry port in the nose but it does not prevent a long-stemmed rivet from swinging back into the supply passage.

It is an object of the present invention to provide for an improved fastening apparatus that operates with increased reliability, accommodates fasteners of differing lengths and can selectively effect joining by fastener insertion or clinching.

BRIEF SUMMARY OF THE INVENTION

According to a first aspect of the present invention there is provided fastener insertion apparatus comprising a nose portion having a fastener delivery passage therein and a fastener entry port, a fastener supply passage and a fastener feeder assembly to advance fasteners from the supply passage to the delivery passage via the entry port, a first actuator reciprocally disposed for movement in said delivery passage for driving a fastener disposed in said delivery passage out of the passage and into a workpiece, wherein the feeder assembly comprises a gate movable between a retracted position in which it is clear of the supply passage and the delivery passage so as to permit movement of a fastener from the supply passage to the delivery passage and an advanced position in which it projects into the delivery passage through the entry port so as to retain a fastener, if present, in the delivery passage.

The gate preferably supports the fastener as it is moved by the first actuator through the delivery passage. In said advanced position the gate is movable from a first advanced position where the fastener is present in the delivery passage to a second advanced position where the fastener is not present in the delivery passage. Ideally, when in the advanced position, the gate is biased towards the second advanced position.

There may be provided a second actuator for moving said gate between said retracted and advanced positions. The second actuator preferably biases the gate in the first advanced position such that if a rivet is not present in the delivery passage the gate projects further into the delivery passage to said second advanced position.

In a preferred embodiment there is provided sensor means for detecting the position of the gate. This may take the form of at least one proximity sensor and preferably comprises two proximity sensors. The sensor means preferably generates a status signal representative of the position of the gate. That status signal may have at least two values, a first value indicating that the gate is in said retracted position and a second value indicating that the gate is in said advanced position. The second value of the status signal preferably indicates that the gate is in the first advanced position. The status signal may have a third value indicating that the gate is in the second advanced position. A fourth value of the status signal may be provided for indicating that there is more than one fastener delivered to the nose. The status signal may have a further value for indicating that the first actuator is in an advanced position.

The gate may have a leading edge for contact with the fastener, punch or a wall of the delivery passage.

Preferably there is provided a fastener support element in the delivery passage for supporting a fastener under the first actuator. That element may be a roller that is retractable into walls of the delivery passage and is biased so as to project into the passage.

The gate may be pivotally mounted and may project into said supply passage when in said advanced position so as to prevent movement of a fastener into the delivery passage.

A fastener sensor is preferably associated with the supply passage and means, such as for example the second actuator, are provided to move said gate from said retracted to said advanced position a predetermined time period after the fastener sensor has been triggered by a passing fastener.

Means may be provided for detecting the wear of the gate.

According to a second aspect of the present invention there is provided fastener insertion apparatus comprising a nose portion having a fastener delivery passage therein and a fastener entry port, a fastener supply passage and a fastener feeder assembly to advance fasteners from the supply passage to the delivery passage via the entry port, a first actuator reciprocally disposed for movement in said delivery passage for driving a fastener disposed in said delivery passage out of the passage and into a workpiece, wherein the feeder assembly comprises a gate movable between a retracted position in which it is clear of the supply passage and the delivery passage so as to permit movement of a fastener from the supply passage to the delivery passage and an advanced position in which it engages a fastener, if present, and retains it in the delivery passage, the first actuator having a surface that co-operates with a surface of the gate so as to move it out of the advanced position when the first actuator drives the fastener out of the delivery passage.

According to a third aspect of the present invention there is provided a method for inserting a fastener into a workpiece using fastener insertion apparatus comprising a nose portion with a fastener delivery passage therein, a fastener supply passage and a fastener feeder assembly to advance fasteners from the supply passage to the delivery passage via an entry port, the method comprising loading a fastener into the delivery passage via the feeder assembly, moving a gate from a retracted position where it is clear of the supply passage and the delivery passage so as to permit movement of a fastener from the supply passage to the delivery passage to an advanced position in which it projects into the delivery passage through the entry port, the gate retaining the fastener, if present, in the delivery passage.

According to a fourth aspect of the present invention there is provided a method for inserting a fastener into a workpiece using fastener insertion apparatus comprising a nose portion having a fastener delivery passage therein, a fastener supply passage, a first actuator reciprocally disposed for movement in said delivery passage for driving a fastener disposed in said delivery passage out of the passage and into a workpiece, a gate movable between a retracted position where it is clear of the supply passage and an advanced position, comprising the steps of supplying a fastener along the supply passage to the delivery passage while the gate is in the retracted position, moving the gate to the advanced position in which it engages a fastener, if present, and retains it in the delivery passage, advancing the first actuator so as to drive the fastener, if present, out of the delivery passage and into the workpiece, the first actuator co-operating with a surface of the gate so as to move it out of the advanced position According to a fifth aspect of the present invention there is provided a method for selectively either inserting a fastener into or forming a clinched joint in a workpiece using fastener insertion apparatus comprising a nose portion with a fastener delivery passage therein, a fastener supply passage and a fastener feeder assembly to advance fasteners from the supply passage to the delivery passage via an entry port, the method comprising optionally loading a fastener into the delivery passage via the feeder assembly, moving a gate from a retracted position where it is clear of the supply passage and the delivery passage so as to permit movement of a fastener, if present, from the supply passage to the delivery passage to an advanced position in which it projects into the delivery passage through the entry port, the gate retaining the fastener, if present, in the delivery passage.

BRIEF DESCRIPTION OF THE DRAWINGS

Specific embodiments of the present invention will now be described with reference to the accompanying drawings in which:

FIG. 2 is a side view of a feeder assembly and a nose assembly forming part of the fastener apparatus of FIG. 1;

FIG. 3 is the same view as FIG. 2 with the nose assembly housing and delivery tube removed for clarity;

FIG. 4 is a perspective view of a gate probe of the apparatus of FIG. 1;

FIG. 5 is a side view of the apparatus of FIG. 2 shown with a rivet in the nose assembly and the gate probe in a forward position;

FIG. 6 is an enlarged view of a tip of the gate probe and the rivet of FIG. 5;

FIG. 7 is a view corresponding to that of FIG. 5 with a slot of the gate probe removed to show a hidden sensor;

FIG. 8 is a side view of the apparatus of FIG. 2 shown without a rivet in the nose assembly and the gate probe in a forward position and with a slot of the gate probe removed to show a hidden sensor;

FIG. 9 is a side view of the apparatus of FIG. 8 shown with an actuator in an extended position;

FIG. 10 is a side view of the apparatus of FIG. 2 shown with two rivets loaded into the feeder head;

FIG. 11 is a schematic perspective view of the gate probe, sensors and rivet retaining rollers in the nose assembly, shown without a rivet present;

FIG. 12 is an enlarged view of the part circled in FIG. 11;

FIG. 13 corresponds to that of FIG. 11 but with a rivet present in the nose assembly;

FIG. 14 is an enlarged view of that part circled in FIG. 13;

FIG. 15 is a side view of the apparatus of FIG. 2 shown with a shot rivet present in the nose assembly and the gate probe in a forward position; and FIG. 16 is an enlarged view of that part circled in FIG. 15.

DETAILED DESCRIPTION OF THE DRAWINGS

Figure 1:
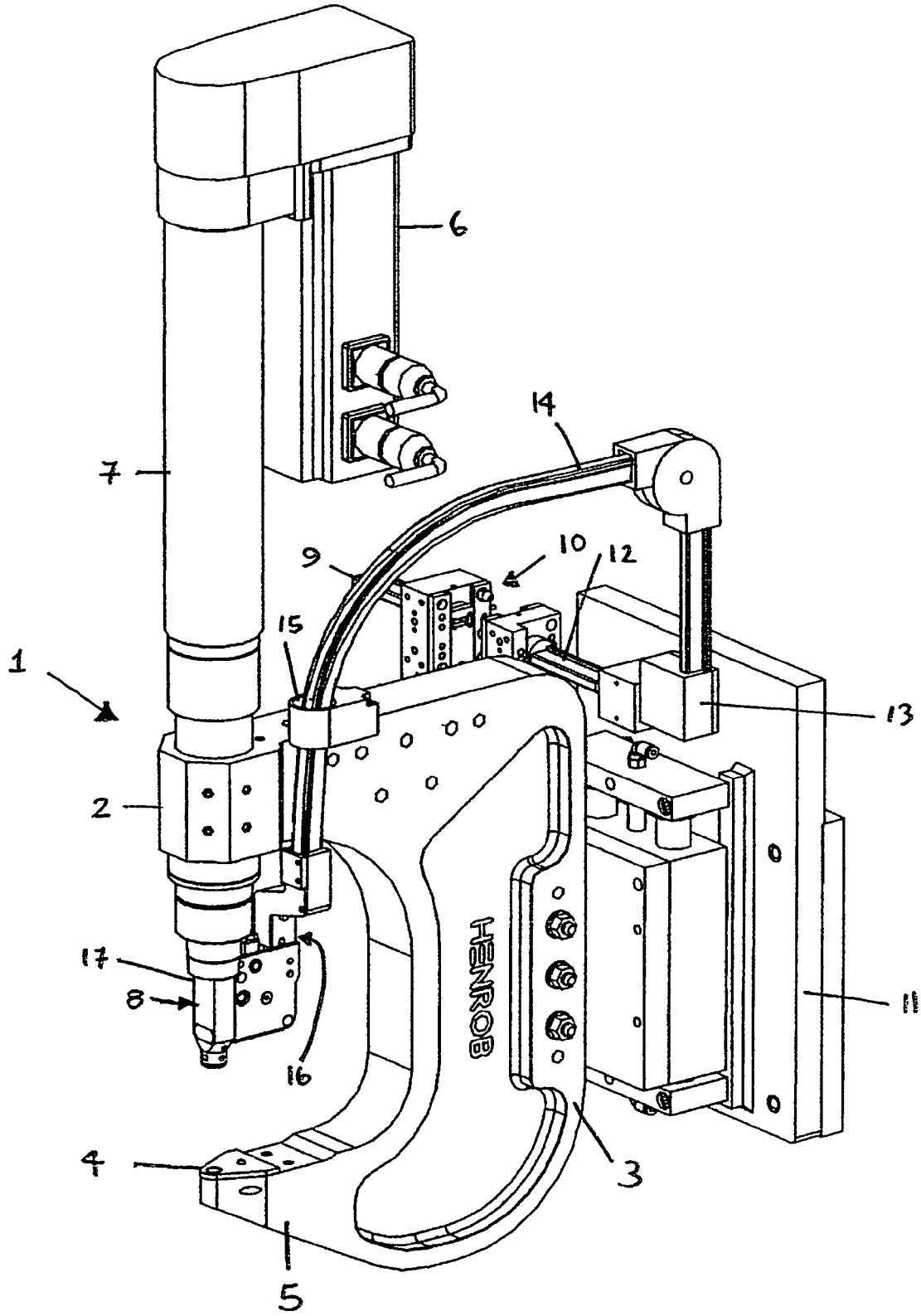
FIG. 1 is a perspective view of a fastener apparatus in accordance with the present invention.

Referring now to FIG. 1 of the drawings, the exemplary fastener insertion apparatus comprises a rivet setting tool 1 that is supported by upper jaw 2 of a C-frame 3 above a fastener-upsetting die 4 disposed on the lower jaw 5 of the frame. Rivets are inserted by the tool into a workpiece (not shown) supported over the die 4 as is well known in the art.

The setting tool 1 comprises an electric drive 6 (other types of drive such as hydraulic or pneumatic can be used in alternative embodiments of the present invention) that operates to drive a reciprocal actuator (hidden in FIG. 1) in a cylindrical housing 7 and an end nose assembly 8 into which rivets are loaded for insertion into the workpiece by the actuator. Rivets are supplied under air or gas pressure from a bulk feeder (not shown) via a first delivery tube 9 that is releasably connectable to the insertion apparatus via a docking station 10. One half of the docking station 10 is connected to the end of the first delivery tube 9 and the other half, being supported on a robot mounting plate 11, is connected to the inlet of a buffer magazine 12. Supplied rivets are intermittently loaded into the buffer magazine 12 and then fed individually to the setting tool 1 via an escapement mechanism 13 and a second (flexible) supply tube 14. A ring proximity sensor 15 detects the passage of a rivet in the tube 14. The rivets are delivered to the actuator via a nose feeder assembly 16 (mostly hidden in the view of FIG. 1) that is mounted immediately adjacent to the nose assembly 8. The present invention is concerned with the structure and operation of the nose feeder assembly 16 and its interrelationship with a control system that monitors the loading of the rivets into the nose assembly 8.

FIGS. 2 and 3 show the feeder assembly 16 and nose assembly 8 in detail. In FIG. 2 the nose assembly housing 17 is shown but the cylindrical housing 7 for the actuator is removed for clarity. In FIG. 3 the nose assembly housing 17 is removed. The feeder assembly 16 comprises a mounting plate 18 by which the assembly is connected to the nose assembly housing 17 at fixing 19. Rivets enter the feeder assembly 16 individually from the second flexible delivery tube 14 (not shown in FIG. 3) at an entry tube 21. They then pass into a supply passage 22 that features a substantially 90° bend. The delivery tube 14, entry tube 21 and the supply passage 22 have an internal T-shaped cross section with an upper chamber 23 that supports the head of the rivet and a lower chamber 24 for receipt of the rivet stem. The lower chamber 24 is of such a dimension that it is able to receive rivets of differing stem lengths. The upper wall 25 of the T-section in the supply passage 22 is slotted so as to receive part of a gate probe 26 (described below).

The nose assembly housing 17 contains a reciprocal punch 27 that is attached to the end of the actuator (not shown in FIG. 2 or 3). The housing 17 defines a vertical fastener delivery passage 28 into which the rivet is loaded from the feeder assembly 16 and along which it is transported towards the workpiece for insertion. The punch 27 is actuable between a retracted position in which it is ready to receive a rivet in the delivery passage 28 and an extended position in which it drives a loaded rivet out of the passage 28 and into the workpiece. The end of the supply passage 22 is communication with the delivery passage 28 via a side port 29 in the housing 17 of the nose assembly 8 so that rivets can be transported directly from the delivery tube 14 into the nose 8 via the supply passage 22. The side port 29 is of a similar shape to the interior of the supply passage 22 and so is able to receive rivets having differing stem lengths.

Above the supply passage 22 the gate probe 26 is pivotally supported on the mounting plate 18 by a pin 30. The probe 26, shown in isolation in FIG. 4, comprises a main body 31 that is connected to the pivot pin 30 by a radially extending arm 32. The main body 31 of the gate probe 26 has a leading tip 33 and a trailing section 34. A peripheral arcuate edge 35 of the gate probe is provided with an elongate slot 36 for detection purposes as will be described later. Two spaced apertures 37, 38 are provided in the arm 32, a first 37 receives the pivot pin 30 and a second 38 supports a collar 39. The gate probe 26 is actuated by a pneumatic cylinder 40 that is also pivotally mounted on the mounting plate 18. The cylinder 40 is provided with air supply ports 41 that control the advancement and retraction of an actuator 42. One end of the actuator 42 extends from the cylinder 40 and is connected to the gate probe 26 by the collar 39. In FIGS. 2 and 3 the gate probe 26 is shown in a retracted position where it is clear of the supply passage 22 and the nose assembly 8.

A pair of elongate proximity sensors 43, 44 is fixed on the mounting plate 18 to the left of the pneumatic cylinder 40 (in the orientation shown in FIGS. 2 and 3) with a space between them. The sensing heads H are disposed immediately above the supply passage 22 and are designed to sense the presence of the main body 31 of the gate probe 26 in front of them. However, they are tuned such that when the slot 36 in the gate probe periphery is in front of them they are not triggered. In the fully retracted rest position shown in FIGS. 2 and 3 the whole of the gate probe 26 is suspended above the supply passage 22 such that its arm 32 extends approximately perpendicularly to the longitudinal axis of the nose assembly 8. In this position the first sensor 43 (that furthest from the nose assembly) senses the presence of the tip 33 of the gate probe 26 and generates an active signal that is received by a controller (not shown) whereas the second sensor 44 (that nearest to the nose assembly) is not triggered as the gate probe clears the sensor head H. This combination of signals effectively informs the control system that the status of the gate probe 26 is fully retracted.

The housing 17 of the nose assembly 8 has a pair of rollers 50 (only one shown in FIG. 3, but both are shown in FIGS. 11 and 12) each of which is spring-biased so as to extend into the fastener delivery passage 28 and is aligned with the intersection of the upper and lower chambers 23, 24 of the supply passage 22. In use, they support the head of a rivet R that is loaded through the side port 29 and are deflected apart (against the spring biasing force) when the punch 27 advances to force the rivet R past them for insertion into the workpiece.

When a rivet R is delivered to the nose it is first detected by the ring sensor 15 before it passes into the feeder assembly 16 and then into the delivery passage 28 of the nose. A short time after the ring sensor 15 is triggered the control system activates the pneumatic cylinder 40 so as to extend its actuator 42 and thereby pivot the gate probe 26 about pin 30 to an advanced position as shown in FIGS. 5, 6 and 7. It will be seen the cylinder 40 itself pivots during this movement. In this position the tip 33 of the probe 26 has passed through the side port 29 and into the delivery passage 28 where it traps the rivet R with its head supported on the rollers 50 (the rollers shown in FIGS. 7, 13 and 14). The movement of the gate probe 26 is accommodated by the slot defined in the top of the supply passage 22. A lower part of the main body 31 of the gate probe 26 occupies the supply passage 22 so as to prevent further rivets R from being passed into the nose assembly 8. The sensors 43, 44 are triggered so that they each generate an active signal representing that a rivet has been successfully loaded into the nose. It can be seen from the illustration in FIG. 7 that the trailing portion 34 of the gate probe 26 is immediately adjacent to both the sensor heads H with the peripheral slot 36 being clear of both the sensor heads H. The gate probe 26 thus simultaneously serves to support the rivet R in the delivery passage 28 of the nose whilst sensing its presence.

If the rivet fails to reach the delivery passage 28 (e.g. it is jammed somewhere in the delivery tube 14, entry tube 21 or supply passage 22) the probe 26 is able to pivot through a slightly greater angle such that the tip 33 advances further into the fastener delivery passage 28 (as shown in FIG. 8). In this position the trailing section 34 of the probe 26 clears the heads H of the sensors 43, 44 so that both generate inactive signals. This combination of signals represents that there is no rivet R in the nose 8 and the rivet insertion operation cannot be initiated.

Once the status of the sensors 43, 44 indicates that a rivet R has been correctly loaded a signal is transmitted by the control system to initiate descent of the setting tool actuator (and therefore the punch 27). As the rivet is pushed down the delivery passage 28 by the punch 27 the gate probe 26 is pushed clear and the tip 33 rides over the external surface of the rivet R and then the external surface of the punch 27 as shown in FIG. 9. This action serves to support the rivet R during its travel along the delivery passage 28 and to ensure that it remains in coaxial alignment therewith.

In the event of a delivery error where two rivets R are delivered to the nose, the probe 26 will be prevented from advancing to the position of FIG. 5 or 6 and will instead be stopped short as illustrated in FIG. 10. In this position only the second sensor 44 is triggered and generates an active signal. The first sensor 43 is not triggered in view of the slot 36 in the gate probe 26.

Prior to the initiation of a rivet loading cycle the gate probe 26 is advanced a first time to determine whether or not the punch 27 is clear of the delivery passage 28 before a rivet is released into the feed assembly. After extended production down times the punch 27 can creep forwards in the delivery passage 28 so that it is partially advanced while the control system is operating on the basis of data indicating that it is retracted. When the gate probe 26 is advanced it either reaches the position shown in FIG. 8 where the punch 27 is fully retracted and clear of the delivery passage 28 (neither sensor is activated) or a position similar to that shown in FIG. 9 where the punch 27 is partially advanced (only the second sensor 44 activated) despite the control system being in receipt of data indicating that it is fully retracted. When the latter configuration is sensed the punch is instructed to retract by the control system. Since the gate probe is biased to the advanced position by the cylinder it moves to the position shown in FIG. 8 as soon as the punch has been retracted. Once it is determined that the punch 27 is fully retracted a new rivet load cycle can be initiated and the gate probe 26 retracts before descending a second time after the rivet has been loaded.

Logic circuitry associated with the sensors 43, 44 and forming part of the control system is used to distinguish between the signal conditions described above and determine the status of the rivet feed operation in accordance with the following table. The control system can then respond to faults by initiating corrective action or activating an appropriate audio or visual alarm to request manual intervention.

| Mechanical status | First Sensor 43 | Second sensor 44 |
|---|---|---|
| Gate probe retracted | 1 | 0 |
| Rivet loaded into delivery passage | 1 | 1 |
| No rivet in delivery passage | 0 | 0 |
| Multiple rivets present or punch advanced | 0 | 1 |

The last row of the table indicates two conditions. These are easily distinguished by the control system by reference to the stage of the fastening cycle. The first descent of the gate probe before initiation of the rivet load cycle is to determine whether the punch is extended or retracted, whereas the second descent of the gate probe after initiation of the rivet load cycle is to determine whether or not the rivet has been successfully loaded.

When the tip 33 of the gate probe 26 becomes worn through use, the position of the gate probe 26 relative to the sensors 43, 44 when it is in contact with a rivet R or the punch 27 will change. This renders the status of the gate probe, as indicated by the sensors, unreliable. In order to counteract this problem, the status of the sensor is determined by the control system and software when the punch 27 is advanced to the position shown in FIG. 9. This is a repeatable position and in this situation only the second sensor 44 should be activated. However, when the tip 33 becomes worn the trailing section 34 of the gate probe 26 moves in front of the first sensor 43 thereby activating it. If the control system determines that both the sensors 43, 44 are activated (normally indicating that a rivet is present in the delivery passage 28) but that the punch 27 has been advanced in accordance with its instructions, a conclusion is reached that the tip 33 of the gate probe 26 is worn. The control system can then issue a signal or alarm to indicate that the worn gate probe needs replacing. The provision of a transducer to sense the gate position makes detection of wear more accurate and efficient.

The present invention enables a range of rivet lengths to be fed to the nose using the same feed assembly. This eliminates the requirement for separate setting tools and feeders dedicated to a particular rivet size. When a short rivet is fed into the delivery passage of the nose there is a high risk of it tumbling during movement along the delivery passage in view of the open space of the side port in the nose assembly housing 17. This risk is reduced by ensuring that the rivet is supported during its descent until at least the stem has passed beyond the bottom of the side port. An example of the gate probe tip 33 supporting a relatively short-stemmed rivet R' is shown in FIGS. 15 and 16. Here it can be seen that the rivet head is still supported by the tip 33 of the gate probe 26 as the end of the stem S reaches the bottom of the side port 29.

The provision of a gate probe that acts as a sensor to check the presence or absence of a fastener and as a gate to prevent delivery of a fastener to the nose when not required gives a very compact arrangement.

The apparatus can also be used to form clinched joints. The workpiece material can be clinched by advancing the punch downwardly without a fastener present in the delivery passage so as to deform the material. A fastener could then be optionally inserted into the clinched joint (one such example of this is described in our European Patent No. 0614405. The apparatus can be used to apply a mix of riveted and clinched joints to the same workpiece by suitable programming of the control system. The movement of the gate probe to the advanced position closes the supply passage so that a rivet cannot be fed. This ensures that the apparatus can form a clinched joint without a fastener.

It is to be understood that numerous modifications may be made to the designs described above without departing from the scope of the invention as defined in the appended claims. For example, the exact arrangement for delivering the fastener to the feeder assembly may take any suitable configuration besides that illustrated in FIG. 1. Indeed the rivets may be supplied under a gravity or vibration feed.

What is claimed is:

1. A method for inserting a fastener into a workpiece using fastener insertion apparatus comprising a nose portion with a fastener delivery passage therein, a fastener supply passage and a fastener feeder assembly to advance fasteners from the supply passage to the delivery passage via an entry port, the method comprising loading a fastener into the delivery passage via the feeder assembly, moving a gate from a retracted position where it is clear of the supply passage and the delivery passage so as to permit movement of a fastener from the supply passage to the delivery passage to an advanced position in which the gate projects into the delivery passage through the entry port and retains the fastener in the delivery passage.

2. A method according to claim 1, wherein in the advanced position the gate at least partially closes the supply passage so as to prevent said movement of a fastener.

3. A method according to claim 1, wherein an actuator is moved in the delivery passage to insert said fastener into the workpiece, the gate supporting the fastener as it is moved by the actuator through the delivery passage so as to prevent tumbling of the fastener.

4. A method according to claim 1, further comprising the step of sensing the position of the gate.

5. A method according to claim 1, wherein the gate is moved out of the advanced position by the first actuator when it moves along the delivery passage to drive the fastener out of the passage.

6. A method according to claim 5, wherein the gate is moved by virtue of a cam action between a surface defined on the gate and a surface of the first actuator.

7. A method for inserting a fastener into a workplace using fastener insertion apparatus comprising a nose portion having a fastener delivery passage therein, a fastener supply passage, a first actuator reciprocally disposed for movement in said delivery passage for driving a fastener disposed in said delivery passage out of the passage and into a workpiece, a gate movable between a retracted position where it is clear of the supply passage and an advanced position, comprising the steps of supplying a fastener along the supply passage to the delivery passage while the gate is in the retracted position, moving the gate to the advanced position in which it engages a fastener and retains it in the delivery passage, advancing the first actuator so as to drive the fastener out of the delivery passage and into the workpiece, the first actuator co-operating with a surface of the gate so as to move it out of the advanced position.

* * * * *